United States Patent [19]

Mainville

[11] Patent Number: 5,024,550

[45] Date of Patent: Jun. 18, 1991

[54] TRENCH GRATE

[76] Inventor: Jack Mainville, 25 Goffe St., North, Meriden, Conn.

[21] Appl. No.: 412,913

[22] Filed: Sep. 26, 1989

[51] Int. Cl.[5] ..... E01C 11/22; E04C 2/42

[52] U.S. Cl. ..... 404/4; 52/169.5; 52/668; 210/163; 404/25

[58] Field of Search ..... 404/2, 4, 5, 25, 26; 29/160; 210/163, 164, 165, 498; 52/19, 20, 21, 660, 665, 668, 169.5; 403/167, 168, 292, 293, 294, 295, 364; 49/50

[56] References Cited

U.S. PATENT DOCUMENTS

| | | | |
|---|---|---|---|
| 1,426,736 | 8/1922 | Hess | 52/668 |
| 1,428,230 | 9/1922 | Hess | 52/668 X |
| 2,031,779 | 2/1936 | Ladd | 52/668 |
| 2,084,118 | 6/1937 | Zabriskie | 52/668 |
| 2,396,735 | 3/1946 | Leigh | 52/668 |

FOREIGN PATENT DOCUMENTS 2931376 2/1981 Fed. Rep. of Germany .

*Primary Examiner*—Stephen J. Novosad
*Attorney, Agent, or Firm*—McCormick, Paulding & Huber

[57] ABSTRACT

A trench grate includes angular frame members having a number of spaced apart rectangular openings along a downwardly extending leg to receive L-shaped tabbed ends of cross members located transversely between the two angular frame members. The portion of the L-shaped tabbed member extending through the opening in the downwardly projecting leg is welded to an outer face of the downwardly extending leg to form an ingegral unit. The trench grate is a single piece unit and rests on the lip surface of a subterranean drainage structure.

5 Claims, 3 Drawing Sheets

TRENCH GRATE

BACKGROUND OF THE INVENTION

The present invention relates generally to water drainage grate structures and deals more specifically with a trench grate.

Trench grates are generally relatively narrow, elongated structures that are used in driveways, parking lots and like paved surfaces to provide a supporting surface for vehicular traffic while permitting the collection of storm water run off into a subterranean basin. Typically, the grates are placed end-to-end in a linear fashion at the vehicular entrance and exists to the paved surfaces and also at other interior locations.

Conventional trench grates generally comprise two parts and are usually made of bar stock. One part is a frame generally having intersecting cross members which are welded to outer edge members of the frame and to one another,to provide an integral structure. The second part generally receives the frame which generally nests in a recessed shoulder area of the receiving portion. The receiving portion is generally located in the upper surface area of the subterranean drainage structure. One drawback with conventional trench grates relates to the difficulty and time consumption required during fabrication since the cross members are generally held by a jig or other fixturing device while the intersections are welded and the ends of the cross members are welded to the inner face surfaces of the outer edge frame members.

A further drawback is the necessity of manufacturing the subterranean drainage structure with the metal frame receiving portion cast in the concrete. Such construction results in a more costly drainage structure and requires shipping the trench grate with the drainage structure.

Another drawback is the welds holding the intersection cross members tend to break with time whereby one or more cross members may break loose leaving a void in the trench grate which presents a hazardous condition to pedestrians and vehicles.

It is therefore a general aim of the present invention to provide an improved trench grate comprised of a single frame part that may be fabricated more easily than conventional trench grates and in a substanitally shorter time whereby it is not required to have a receiving portion cast in the drainage structure.

It is another aim of the invention to provide a trench grate wherein surface support is still provided in the event of a weld failure.

SUMMARY OF THE INVENTION

In accordance with the present invention, a trench grate includes two elongated angular frame members each having spaced support openings extending longitudinally along the inner face of one leg. A number of cross members having L-shaped tabbed ends are located transversely to the two angular frame elements such that the L-shaped tabbed ends are received within the openings of the leg of the angular frame elements. The L-shaped tabbed portions of the transverse cross members extend through the openings and except for the two outermost cross members are spot or tack welded along the intersection of the cross member and the outer face surface of the leg of the angular frame member. The angular frame element further includes a supporting leg intersecting the one leg and extending generally outward and perpendicularly to the face of the leg.

The trench grate rests in and is supported in a complementary recessed surface portion of the concrete subterranean drainage structure without the necessity of a second receiving metal frame portion cast in the concrete. Since the drainage structure is cast with concrete only, a manufacturer can have a larger inventory with less cost since the trench grate can be purchased separately and only when needed at time of installation.

BRIEF DESCRIPTION OF THE DRAWINGS

Other features and advantages of the present invention will become readily apparent from the following written description and figures wherein.

DESCRIPTION OF PREFERRED EMBODIMENTS

Figure 1:
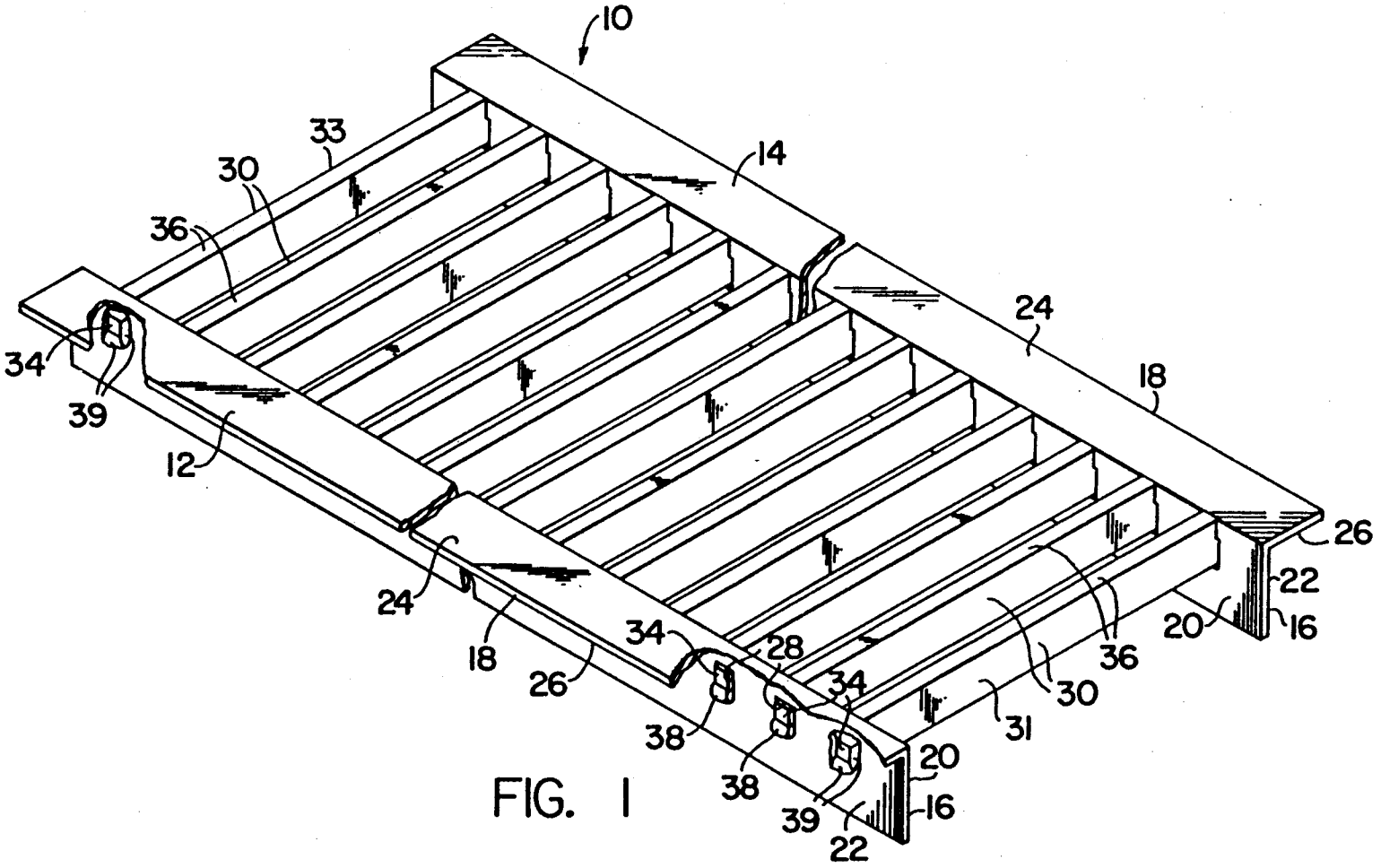
FIG. 1 is a perspective view of the trench grate of the present invention.
Figure 2:
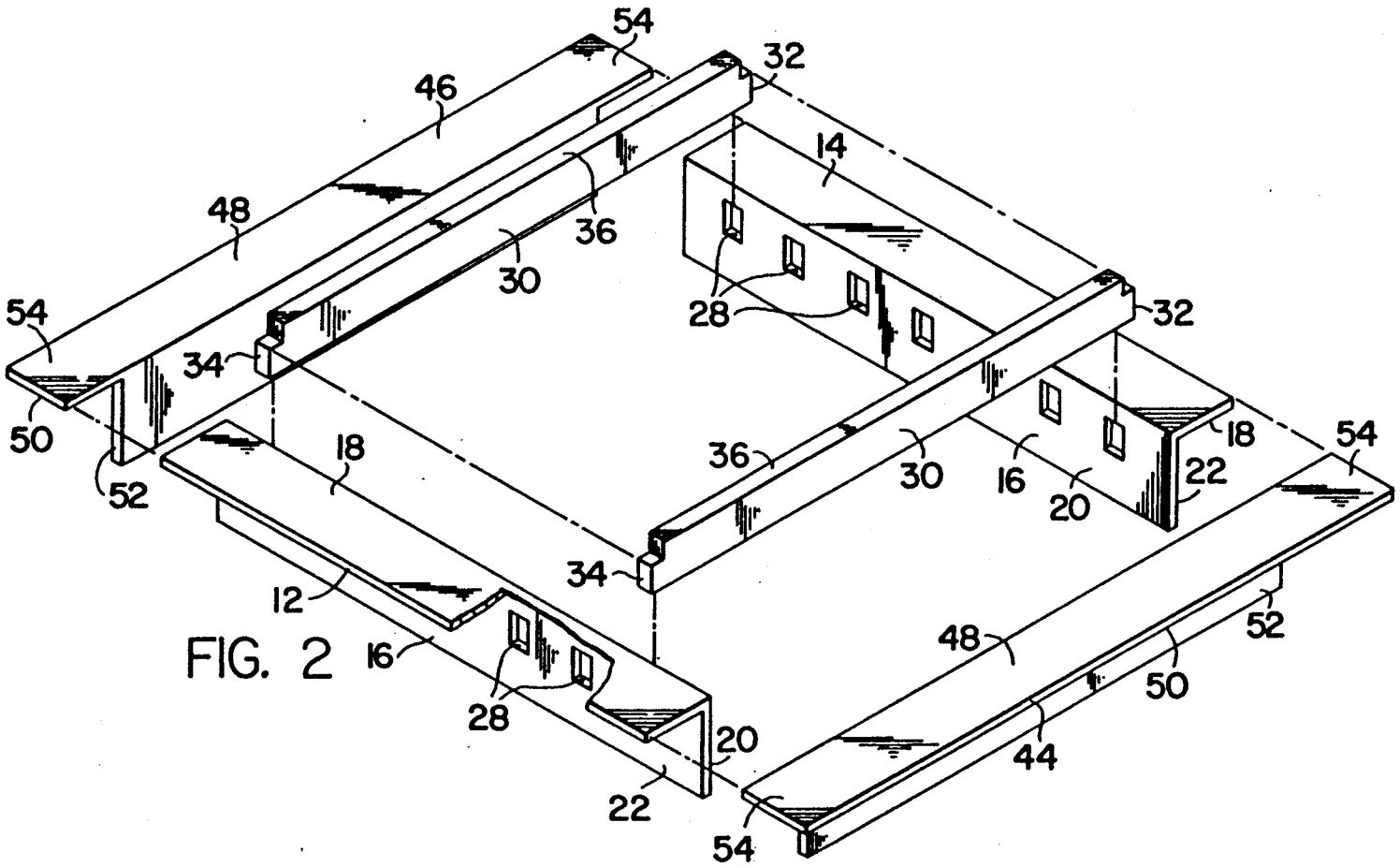
FIg. 2 is an exploded, perspective view of the trench grate of the present invention including transverse angular frame members to adapt the trench grate for use with a conventional storm water catch basin.

Turning now to the drawings and FIGS. 1 and 2 in particular, the trench grate of the present invention is shown therein and generally designated 10. The grate 10 includes two angularly shaped frame members 12, 14 made of a bar stock iron material and each having downwardly projecting leg portions 16 and a support leg 18 extending outwardly and generally perpendicularly to the leg 16. The downwardly projecting leg 16 includes an inner face 20 and outer face 22. The support leg 18 includes a support surface 24 and a resting surface 26. Each of the angular frame members 12, 14 include a number of rectangular shaped openings 28, 28 extending through the leg 16 between the inner face surface 20 and outer face surface 22.

A support cross member 30 includes L-shaped tabbed ends 32, 34 which are received in a complementary arrangement with the rectangular openings 28, 28 of the frame members 12, 14 such that an upper surface 36 is substantially coplanar with the support surface face 24 of the frame member 12, 14 when the cross member 30 and frame member 12, 14 are in cooperating engagement. The cross member 30 is also made of a bar stock iron material.

The construction of the trench grate 10 is such that the cross members 30, 30 are arranged transversely to the longitudinal direction of the frame member 12, 14 which frame members are disposed opposite one another in a spaced relationship with the inner face 20 of one facing the inner face 20 of the other as illustrated. The cross members 30, 30 are held to the frame members 12, 14 by spot or tack welds 38, 38 made between the portion of the L-shaped tabbed ends 32, 34 extending through the leg 16 and the outer face 22 of the frame member 12, 14. The two outermost members 31, 33 are held to the frame member 12, 14 by welds 39, 39 substantially along the entire intersection formed between the cross member ends 34 and the face 22 of the frame members 12, 14.

Figure 3:
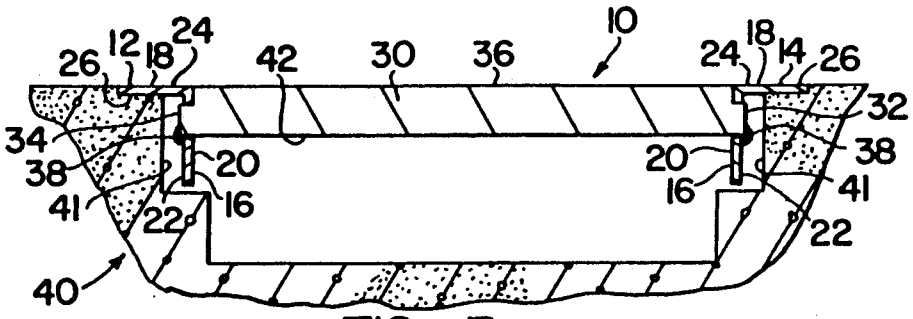
FIG. 3 is a cross sectional view of the trench grate of the present invention shown in place on a subterranean drainage structure.

As shown in FIG. 3, the trench grate of the present invention is preferably located so that it rests and is supported on its resting surface 26 by a concrete drainage structure generally designated 40 and which is shown for illustrative purposes only. Unlike conventional trench grates, the grate of the present invention does not nest in nor is it supported by a second receiving metal frame portion cast in the concrete of the drainage structure. In fact, as illustrated, the downwardly projecting legs 16 do not nest on any lips or portion of the drainage structure nor is the inner wall surface 41, 41 of the structure in contact with the face 22 of the frame member 12, 14. It will be readily recognized by those skilled in the art that there are numerous other methods and ways of locating the trench grate of the present invention with a subterranean drainage structure.

An advantage of the present invention will become apparent when considering FIG. 3. If a weld 38 breaks for any reason, the cross member 30 is still supported by the L-shaped tabbed portion 32 which is in complementary engagement with the rectangular opening 28 in the leg 16 such that the lower surface face 42 of the cross membr 30 is supported even though the weld 38 is broken. It will therefore be seen the trench grate of the present invention will provide surface support even when the welds of one or more cross members 30 are broken.

If the load capacity of the trench grate is exceeded, the leg 18 of the frame member 12, 14 will deform or bend causing the frame members to come into contact with the concrete lip of the drainage structure to provide the required support for the excessive load being supported. Accordingly, the trench grate of the present invention provides all the benefits of a fully supported, two portion conventional trench grate without the attendant costs and drawbacks. In addition, to its fail safe operation, the present trench grate provides support even if a weld breaks on a cross member.

Figure 4:
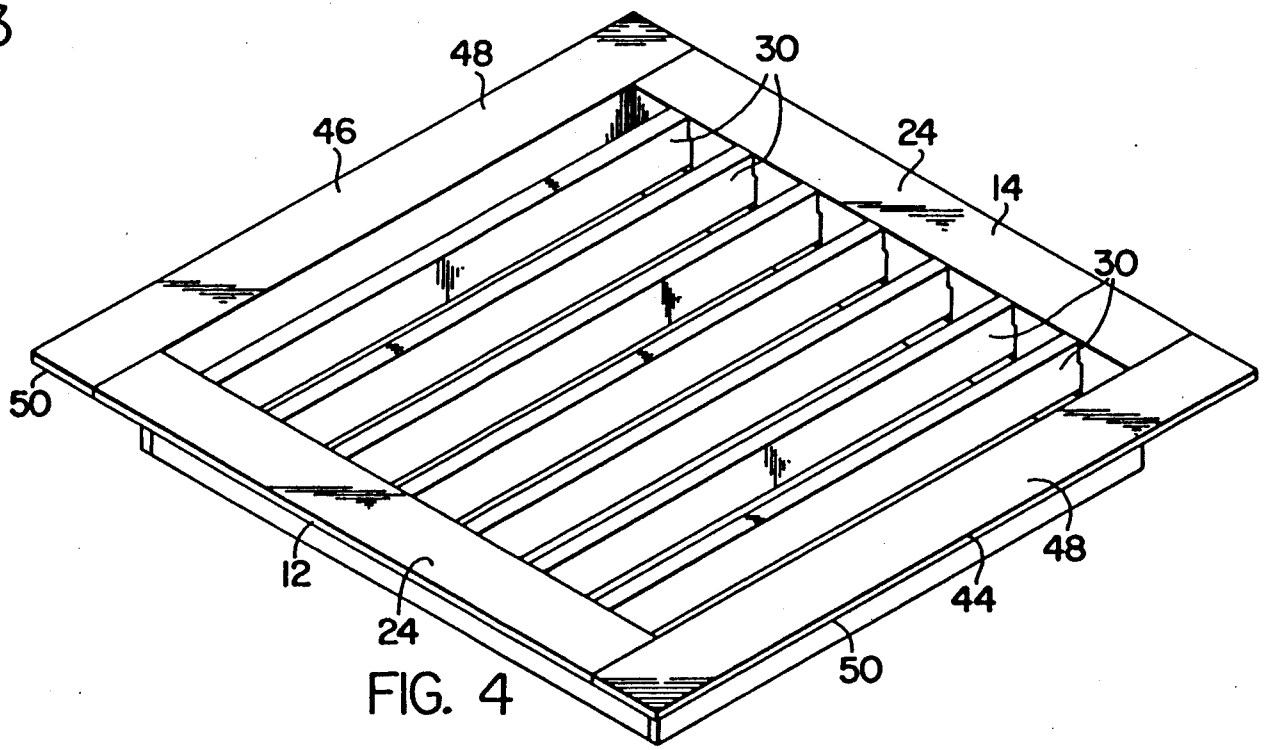
FIG. 4 is a perspective view of the trench grate of the present invention with transverse angular frame members.

As illustrated in FIGS. 2 and 4, additional transverse angular frame members 44, 46 may be welded to the trench grate structure to adapt the grate for use with a conventional rectangular subterranean catch basin well known to those skilled in the art. The transverse angular frame members are substantially identical to one another and include support surface faces 48, 48 and resting surfaces 50, 50. The transverse frame members 44, 46 each include a downwardly extending leg 52 and an outwardly projecting leg 54 substantially perpendicular to the leg 52. The length of the leg 54 is longer than the length of the leg 52 and extends at both ends beyond the leg 52 and coextensive with the width of the trench grate as illustrated in FIG. 4. The length of the leg 52 is coextensive with the spaced apart distance between the angular frame members 12, 14 when the cross members 30, 30 are inserted such that the outer edges of the leg 52 are substantially coplanar and in alignment with the outer face 22. The transverse frame members 44, 46 are welded to the trench grate structure along the intersecting surfaces of legs 52 and 16 and 54 and 18, respectively to form an integral unit.

A trench grate embodying the present invention is described above in several preferred embodiments for purposes of explanation. It will be recognized that changes may be made to the secific configuration of the elements comprising the trench grate without departing from the scope of the invention and therefore the invention has been described by way of illustration rather than limitation.

I claim:

1. In combination with a drainage structure of the type having an external supporting surface and inner side wall surfaces disposed inwardly and below said external supporting surface, a trench grate comprising:

a first and second elongated, angular frame member each having a downwardly extending leg and a supporting leg intersecting with and along the length of said downwardly extending leg and extending substantially perpendicular to said downwardly extending leg, said downwardly extending leg having an inner face surface and an oppositely disposed outer face surface, said supporting leg having a upwardly facing support surface face and a resting surface disposed opposite thereto;

each of said supporting legs being sized to engage with the external supporting surface of said drainage structure and to space each of said outer face surfaces of said downwardly extending legs from said adjacently disposed inner wall surface of said drainage structure;

each of said downwardly extending legs including a number of spaced apart, generally rectangularly shaped openings extending through said downwardly extending leg between said inner face surface and said outer face surface, said openings lying along a common axis extending longitudinally along said leg and substantially parallel to the intersection between said downwardly extending leg and said supporting leg;

a plurality of elongated cross members having a generally rectangular shape and an upper face and lower face disposed opposite thereto, said cross member having two L-shaped, tabbed end portions having the same general shape as said rectangularly shaped openings in said downwardly extending leg;

said cross members being located transversely between said first and second frame members and in a spaced, parallel relation to one another such that said cross members extend exclusively transversely across said trench grate, one of said L-shaped, tabbed end portions being received in one of said openings in said first frame member and the other of said L-shaped, tabbed end portions being received in one of said openings in said second frame member, said first and second frame members being arranged with the inner face surface of one facing the inner face surface of the other and said rectangularly shaped openings is one being in registry with the rectangularly shaped openings in the other, and means for interconnecting said first and second frame members and said cross members to form an integral trench grate structure such that when the load capacity of the trench grate is exceeded, each of said supporting legs bends and causing each of said downwardly extending legs to contact said adjacently disposed inner walls of the said drainage structure to provide additional support for the excessive load being applied.

2. A trench grate as defined in claim 1 wherein a plurality of cross members are welded at positions defined by at least a portion of the intersection of said L-shaped tabbed portion and said outer face surface of said first and second frame members.

3. A trench grate as defined in claim 1 wherein said cross members are located transversely between said first and second frame members one-for-one with said rectangular shaped openings.

4. A trench grate as defined in claim 3 wherein each of said cross members are welded at each of the positions defined by at least a portion of the intersection of said L-shaped tabbed portions and said outer face surface of said first and second frame members and the outermost cross members are welded along substantially all the intersection of said L-shaped tabbed portions and said outer face surface of said first and second frame members.

5. A trench grate as defined in claim 4 further comprising a first and second transverse angular frame member connected between said first and second frame members, said first transverse angular frame member being located at a first outermost end of said trench gate structure and said second transverse angular frame member being located at an outermost end of said trench grate structure opposite said first outermost end.

* * * * *